US005152953A

United States Patent [19]

Ackermann

[11] Patent Number: 5,152,953

[45] Date of Patent: Oct. 6, 1992

[54] INSTALLATION FOR THE FLAME METALIZATION OF SMALL PIECES OF STEEL OR CAST IRON

[76] Inventor: Werner Ackermann, Thurnstrasse 35, D-5900 Siegen, Fed. Rep. of Germany

[21] Appl. No.: 702,175

[22] Filed: May 20, 1991

[30] Foreign Application Priority Data

May 19, 1990 [DE] Fed. Rep. of Germany ..... 4016172

[51] Int. Cl.[5] ..... C21D 5/00

[52] U.S. Cl. ..... 266/252; 266/276; 432/261

[58] Field of Search ..... 266/105, 107, 252, 274, 266/276; 432/261

[56] References Cited

U.S. PATENT DOCUMENTS

| | | | |
|---|---|---|---|
| 2,605,092 | 7/1952 | Hutchinson et al. | 432/261 |
| 3,320,085 | 5/1967 | Turner, Jr. | 266/107 |
| 4,170,495 | 10/1979 | Talikka | 148/15 |
| 4,431,408 | 2/1984 | Postich | 432/261 |
| 4,978,109 | 12/1990 | Vigouroux | 266/274 |

FOREIGN PATENT DOCUMENTS 0146788 7/1985 European Pat. Off. .

*Primary Examiner*—Scott Kastler
*Attorney, Agent, or Firm*—Young & Thompson

[57] ABSTRACT

Installation for the hot-metallizing of small items of steel or cast iron, comprising a continuous annealing furnace (1) with a furnace chamber (2) having regulatable temperature zones, a feeding device (3) for conveyor boxes (4) to accommodate the metal parts to be metallized, conveying devices (6, 9) for transporting the conveyor boxes (4) through the annealing furnace (1) and back to a discharge device (10), a vacuum inlet gate (5), and a vacuum outlet gate (7) which are under a protective gas atmosphere. A device (11) is arranged within the vacuum outlet gate (7) for emptying the conveyor boxes (4) into circulating dip baskets (13) of a metallizing plant (12) connected to the continuous annealing furnace (1), comprising a ceramic-lined, inductively heated metal bath (14). Lifting units lower the dip baskets (13) from a circulating position (13*a*) into a dipping and filling position (13*c*) into the metal bath (14) and lift the baskets (13) into a position (13*e*) above the metal bath (14). The annealing furnace (1) has a cooling zone (8), the furnace chamber (2) and the cooling zone (8) containing a pusher device (6, 9) for the cyclic feeding of the conveyor boxes (4).

6 Claims, 7 Drawing Sheets

INSTALLATION FOR THE FLAME METALIZATION OF SMALL PIECES OF STEEL OR CAST IRON

The invention relates to an installation for the hot-metallization of small items of steel or cast iron.

In such an installation, known from EP 1 46 788 A2 in conjunction with U.S. Pat. No. 4,170,495, for the hot-galvanizing of metallic small items, such as bolts, one dipping basket is merely utilized in the galvanizing bath so that the installation is not suited for an economical mass production of galvanized individual items.

The invention is based on the object of rendering the installation of this type for the hotmetallizing of small items ready for use in an economical mass production.

The installation of this invention for the hot-metallization of metallic small items is distinguished by high production outputs. The installation makes it possible to combine the customary heat treatment processes in case of metallic parts, such as stress relief annealing, normalizing, and bright annealing, with an immediately following hot-metallizing process. There is furthermore the possibility of effecting, with the installation for annealing and hotmetallizing of metal parts, merely an annealing treatment of the parts. The annealing treatment of the metal parts under a protective gas, replacing the still frequently used pretreatment processes, such as pickling in an acid, flux treatment, and predrying, permits an optimum preparation of the items for the hot-metallization by a reduction or, respectively, a complete breakdown of the materials present in the surface of the parts to be metallized, such as phosphorus and silicon, which affect the reaction time between the metallic starting material of the parts and the liquid metal of the bath during metallizing, as well as by a bright annealing of the parts. By the elimination of the interfering factors which have a varying influence on the reaction time, it is possible to attain a uniform thickness of the metal cladding on the metal parts, controllable over the reaction time, primarily in connection with steel parts, independently of the steel quality. The installation makes it possible to employ alloying bathsduring metallizing, such as, for example, zinc-aluminum baths, so that metal parts having high-quality metal alloys as a cladding can be manufactured. Finally, the temperature of the parts fed to the metallic bath under a protective gas atmosphere can be regulated by the regionally controllable furnace temperature to a specific temperature value above the temperature of the metallic bath, independently of the fact whether metallizing is carried out at a low, normal, or high temperature. This measure affords the advantage that the heating-up phase of the parts to be coated is eliminated and the radiation losses of the electrically inductively heated metal bath are compensated for so that, by the possible shortening of the dipping sequence of the dipping baskets with the parts to be metallized, an increase in productivity is attained with a simultaneous saving in energy.

The invention will be described hereinbelow with reference to various schematically illustrated installation. In the drawings:

Figure 1:
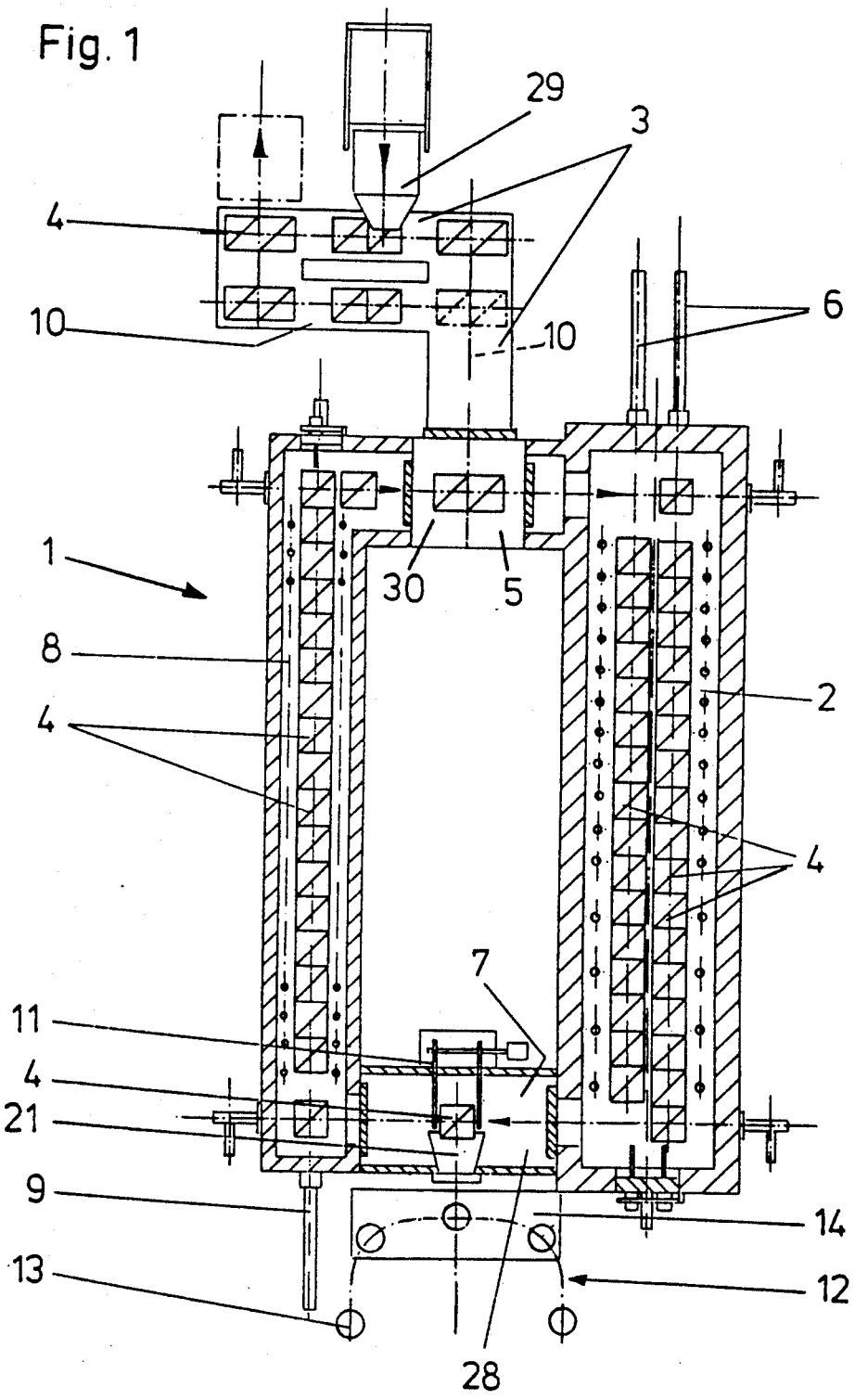
FIG. 1 shows a longitudinal sectional view of a continuous annealing furnace with a subsequently arranged, partially illustrated metallization installation.
Figure 2:
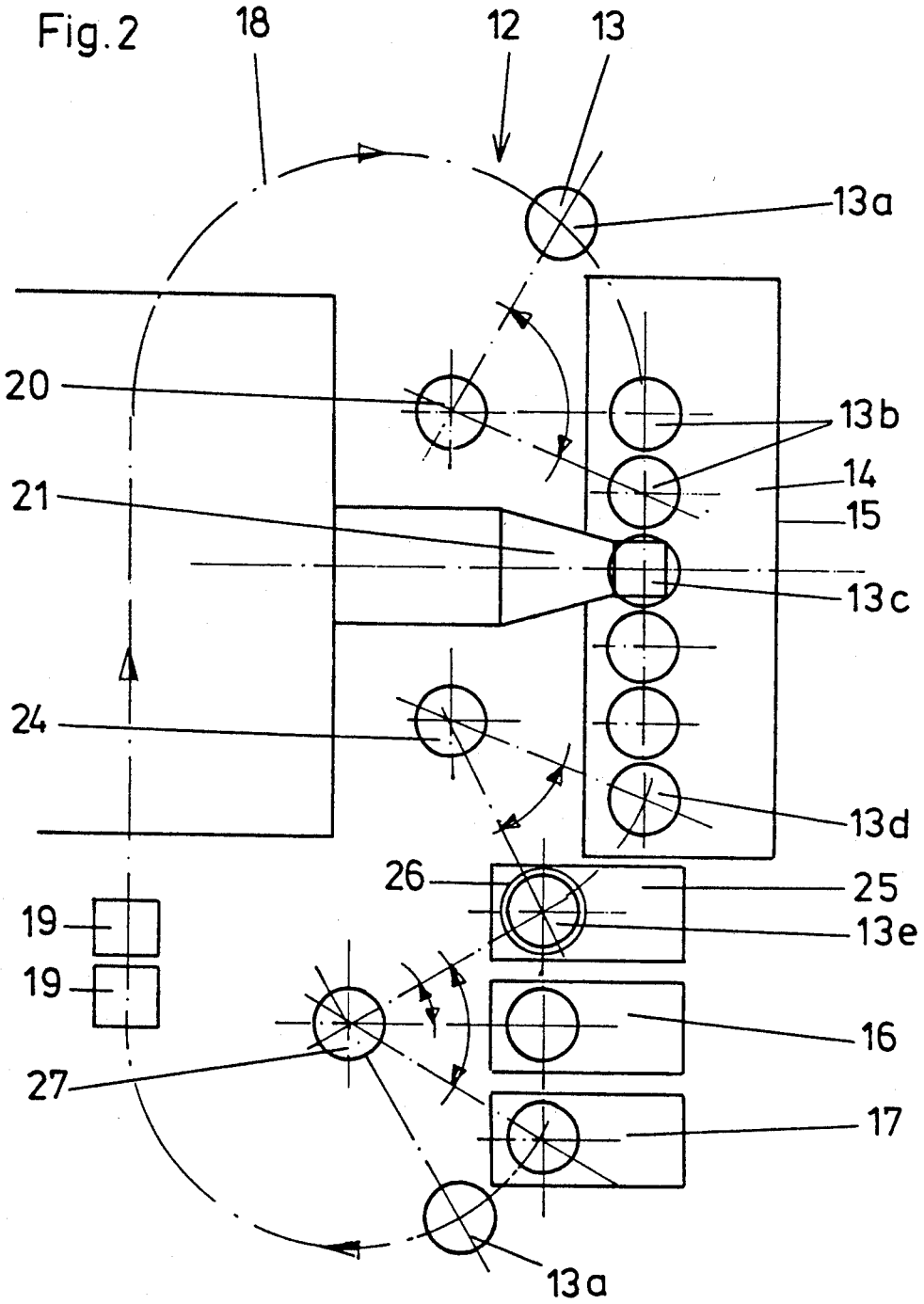
FIG. 2 is a top view of the metallization installation of FIG. 1.
Figure 3:
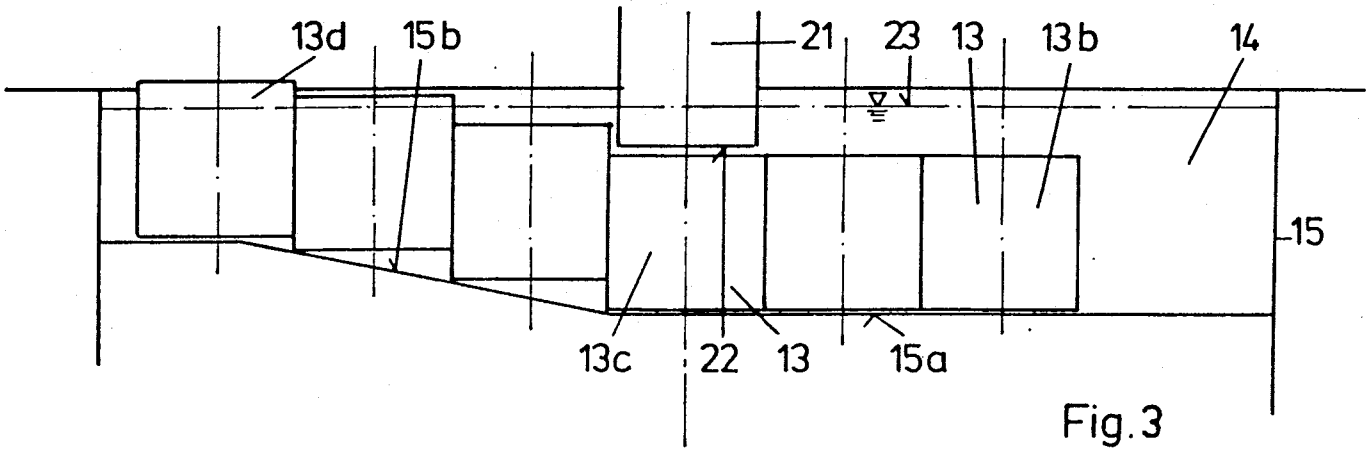
FIG. 3 shows a longitudinal section and FIG. 4 shows a cross section of the metal bath of the metallization installation of FIG. 2, FIGS. 5 and 6 show top views of two other metallization installations.
Figure 4:
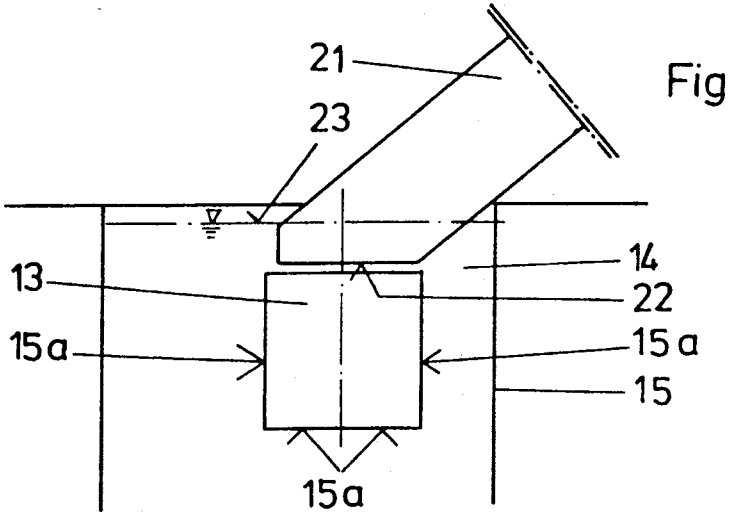

Main parts of the installation for the hotmetallization of small items of metal, for example for the hot-galvanizing of screws, nuts and rivets of steel, are constituted by a protective-gas continuous annealing furnace 1 with a furnace chamber 2 with regulatable temperature zones, a feeding device 3 for conveyor boxes 4 to accommodate screws to be galvanized, a vacuum inlet gate 5, a pusher-type device 6 for the cyclic advance of the conveyor boxes 4 through the furnace chamber 2, a vacuum discharge gate 7, and a cooling zone 8, separated from the furnace chamber 2 by the inlet gate 5 and the outlet gate 7 and being under a protective gas atmosphere, with a pusher-type device 9 for the cyclic advancement of the emptied conveyor boxes 4 toward a removal unit 10, as well as a device 11 for emptying the conveyor boxes 4 into circulating dip baskets 13 of a metallizing installation 12, e.g. a galvanizing plant, connected to the continuous annealing furnace 12; this device 11 is arranged within the vacuum outlet gate 7.

A transverse conveyor 28 conveys the conveyor boxes 4 from the furnace chamber 2 through the outlet gate 7 into the cooling zone 8.

The core section of the galvanizing installation 12 is a metal bath 14 with an electrically inductively heated, ceramic-lined dipping basin 15, filled with liquid zinc; quenching and aftertreatment baths 16, 17 adjoin this dipping basin.

A roller conveyor belt 18 transports the dip baskets 13 with the galvanized small items, such as screws, after passing through the metal bath 14 and the quenching and aftertreatment baths 16, 17, to the unloading stations 19 with tilting units for the dip baskets 13, and transports the empty dip baskets 13 from the unloading stations 19 to the inlet zone of the metal bath 14.

A manipulator 20 lifts the empty dip baskets 13 off the roller conveyor belt 18, lowers the dip baskets 13 from the circulating position **13*a* into the dipping position 13*b* into the metallic bath 14, and transports the dip baskets 13 cyclically by way of a guide means 15*a* through the metal bath 14 by way of the filling position 13*c* into the discharge position 13*d*. In the filling position 13*c*, the dip baskets 13 accept the small items, such as screws, to be galvanized; the latter are emptied by means of the emptying device 11 installed within the vacuum outlet gate 7 and designed as a tipping means from the conveyor boxes 4 leaving the furnace chamber 2 of the annealing furnace into a funnel-like filling device 21. The outlet opening 22 of the latter is arranged below the level 23 of the metal bath 14 and above the dip basket 13** to be respectively charged.

A manipulator 24 lifts the dipping baskets 13 in the removal position **13*d* out of the metal bath 14 into the rotary position 13*e*, entering a centrifuge 26 located above a separate collecting basin 25** wherein the excess zinc is flung off the screws.

A further manipulator 27 transports the dip baskets 13 after the centrifuging step through the quenching and aftertreatment baths 16, 17 to the roller conveyor belt 18.

The rearward section 15*b* of the basket guide means 15*a* in the dipping basin 15 of the metal bath 14 constitutes an inclined guide means for lifting the dip baskets 13 from the dipping position 13*b* into the discharging position 13*d*.

The forward region of the dipping basin 15 of the metal bath 14 is freely accessible for taking care of the bath as well as for servicing and repair work.

In a modification of the aforedescribed galvanizing installation 12, the manipulator 27 for lifting the dip baskets 13 into the rotary position 13*e* can be fashioned as a rotational unit wherein the dip baskets 13 are accommodated, in the rotary position 13*e*, by a protective cover above the dipping basin 15 of the metal bath 14 or by a separate collecting basin 25.

The degreased and sandblasted small items, such as steel screws, to be galvanized are filled by means of a filling device 29 batchwise into the empty conveyor boxes 4 which, in a specific working cycle, are removed from the cooling zone 8 of the continuous annealing furnace 1 by the discharge device 10 by way of the vacuum inlet gate 5 and are transported by the feeding device 3 to the filling device 29. The conveyor boxes 4, filled with screws, are transported by the feeding means 3 through the inlet gate 5 to a transverse conveyor 30 which latter transfers the conveyor boxes 4 to the pusher-type device 6 in the furnace chamber 2. The steel screws, pushed by means of the pusher-type device 6 with the conveyor boxes 4 batchwise in a specific working cycle through the furnace chamber 2, are bright annealed at about 900° C. under a protective gas atmosphere, the composition of the protective gas being selected so that, by the annealing treatment, the effect of phosphorus and silicon contained in the surface of the steel screws on the reactivity of the steel with respect to the zinc during the subsequent hot-galvanizing in the zinc bath of the galvanizing plant 12 is eliminated or, respectively, reduced. The annealed screws are cooled down in the rearward section of the furnace chamber 2 to a temperature of about 500° C. by a corresponding regional regulation of the furnace temperature. The conveyor boxes 4 with the annealed screws are transported by the transverse conveyor 28 into the vacuum outlet gate 7 wherein the screws, under a protective gas atmosphere, are emptied in batches via the filling device 21 into the circulating dip baskets 13 of the galvanizing plant 12 immediately adjoining the annealing furnace 1. The empty conveyor boxes 4 pass via the transverse conveyor 28 into the cooling zone 8 of the annealing furnace 1 and ar conveyed by the pushertype device 9 through the cooling zone to the discharge means 10 and back to the feeding device 3. After the hot-galvanizing of the screws in the zinc bath 14 of the galvanizing plant 12 at a bath temperature of 450° C., the galvanized screws are emptied from the dip baskets 13 in unloading stations 19 and optionally subjected to additional aftertreatments, such as chromating, phosphatizing, and oiling.

The continuous annealing furnace 1 can also be readily operated in such a way that a portion of the small-item batches filled into the conveyor boxes 4 is annealed and galvanized and another portion of the smallitem batches is merely annealed.

Furthermore, there is the possibility of operating the continuous annealing furnace solely for pure annealing purposes. In this case, the emptying device 11 for the conveyor boxes 4 and the galvanizing plant 12 connected to the annealing furnace 1 are rendered inoperative.

Figure 5:
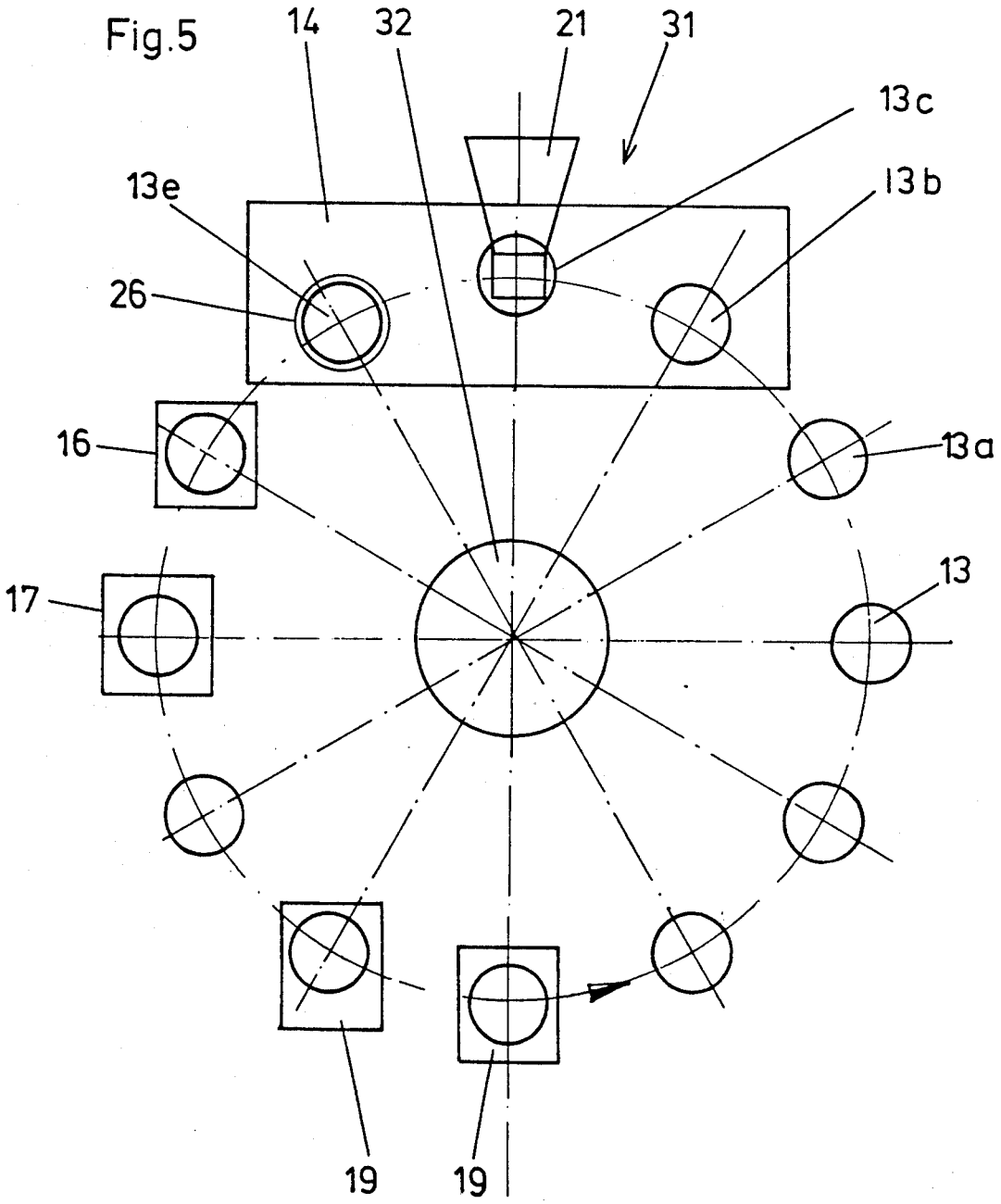

In the galvanizing installation 31 according to FIG. 5, a main manipulator 32 is utilized, designed as a column swiveling device, taking over the functions of the roller conveyor belt 18 as well as of the manipulators 20, 24 and 27 of the aforedescribed galvanizing plant 12 according to FIGS. 1-4.

Figure 6:
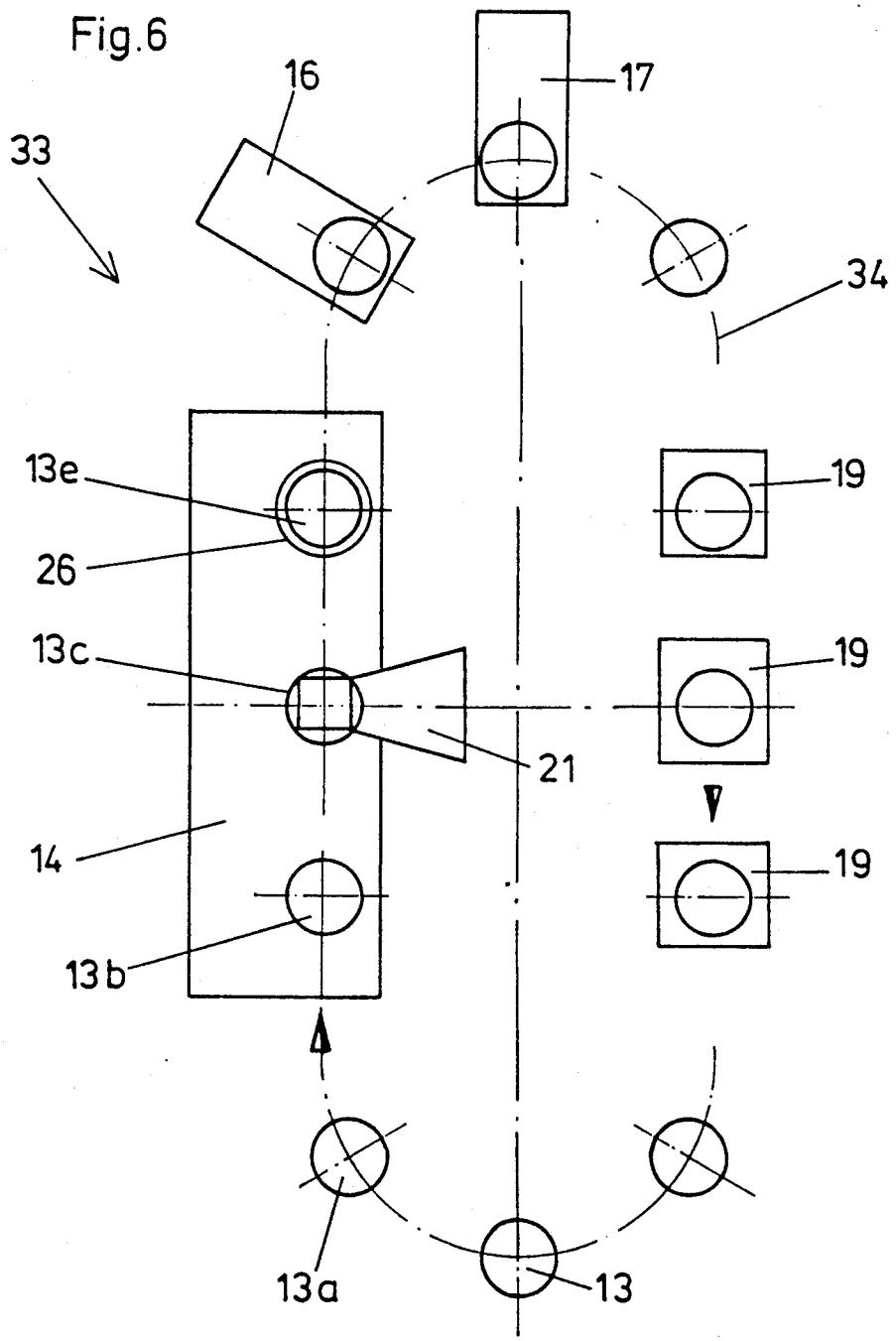
Figure 7:
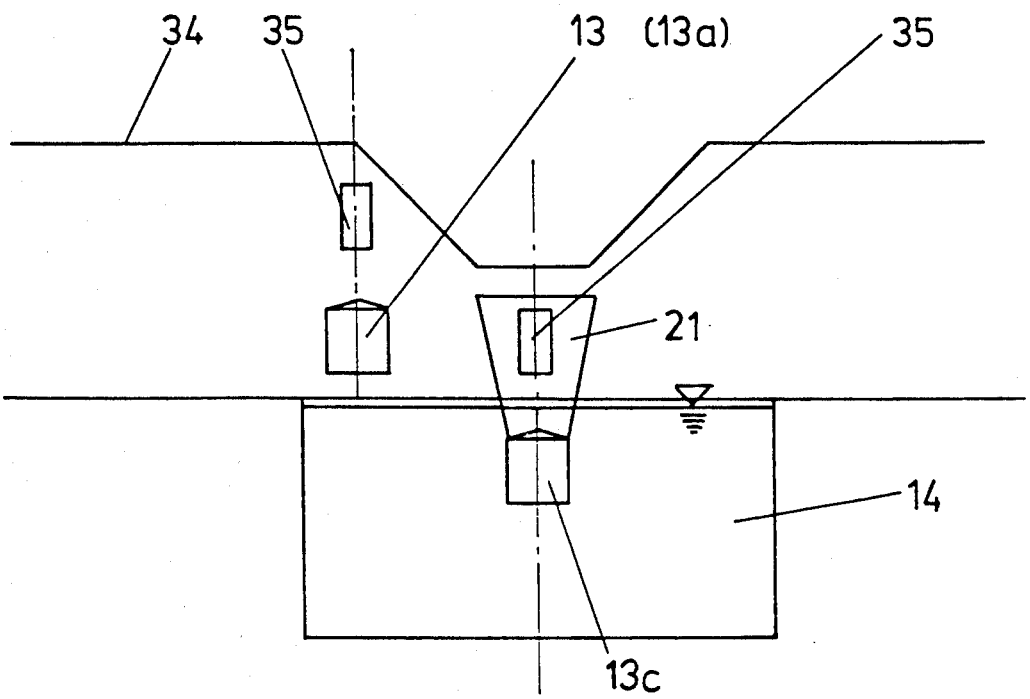
FIG. 7 is a longitudinal section of the metal bath of the metallization installation of FIG. 6.

In the galvanizing installation 33 of FIGS. 6 and 7, an endless chain conveyor 34 performs the functions of the roller conveyor belt 18 as well as of the manipulators 20, 24 and 27 of the galvanizing plant 12 according to FIGS. 1-4, and each dip basket 13 is equipped with the pneumatic motor 35 for the rotary drive.

Figure 8:
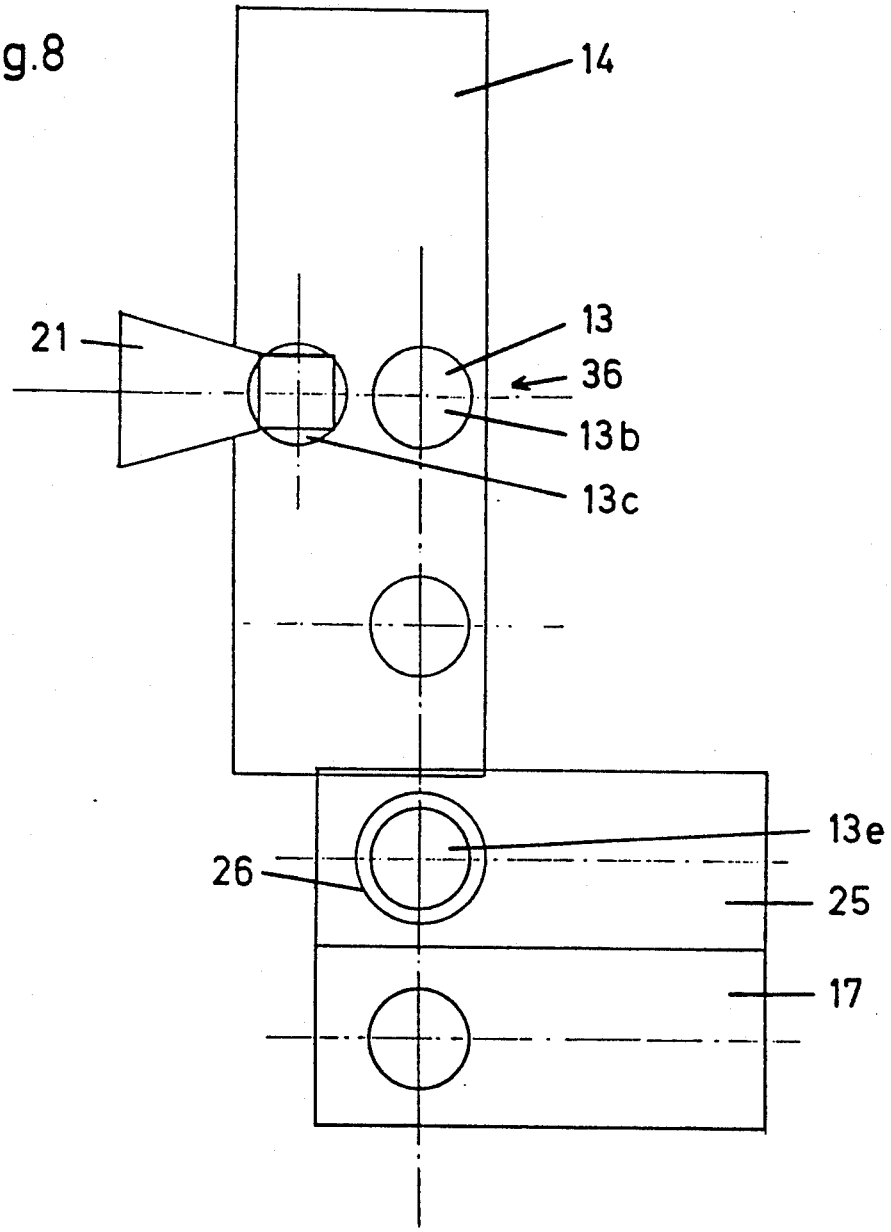
FIG. 8 shows a top view of another metallization installation.

The galvanizing plant 36 of FIG. 8 operates with a linear manipulating device, not shown, and with a dip basket 13. The empty dip basket 13 is lowered by the manipulating device into the dipping position 13*b* into the zinc bath 14 and is pushed into the filling position 13*c* underneath the filling device 21 into which the conveyor boxes 4 coming from the furnace chamber 2 of the annealing furnace 1 are emptied of small items, such as screws. The manipulating device transports the filled dip basket 13 by way of the dipping position 13*b* through the zinc bath 14 and lifts the dip basket into the rotational position 13*e* into a centrifuge 26 above a separate collecting basin 25 or the zinc bath 14. After the centrifuging process, the manipulating device removes the dip basket 13 from the centrifuge 26 and empties the basket into an aftertreatment bath 17. Thereafter, the manipulating device conducts the empty dip basket 13 back again into the dipping position 13*b* and the filling position 13*c* in the zinc bath 14 for the renewed filling with small items from the annealing furnace 1. The manipulator employed can also be an articulated robot with several axes.

I claim:

1. Installation for the hotmetallizing of small items of steel or cast iron, with a continuous annealing furnace containing a protective and reducing gas, as well as with a metal bath connected, by way of a feeding device that is under a protective gas atmosphere, with the continuous annealing furnace, comprising a continuous annealing furnace (1) with a furnace chamber 92) having regulatable temperature zones, a feeding device (3) for conveyor boxes (4) to accommodate the metal parts to be metallized, conveying devices (6, 9) for transporting the conveyor boxes (4) through the annealing furnace (1) and back to a discharge device (10), a vacuum inlet gate (5), and a vacuum outlet gate (7) which are under a protective gas atmosphere, and with a device (11) arranged within the vacuum outlet gate (7) for emptying the conveyor boxes (4) into circulating dip baskets (13) of a metallizing plant (12) connected to the continuous annealing furnace (1), comprising a ceramic-lined, inductively heated metal bath (14), lifting units for lowering the dip baskets (13) from a circulating position (13*a*) into a dipping and filling position (13*c*) into the metal bath (14) and lifting of the baskets (13) into a position (13*e*) above the metal bath (14), a motorized rotational drive mechanism for the dip baskets (13), quenching and aftertreatment baths (16, 17) arranged downstream of the metal bath (14), as well as unloading stations (19) with tilting devices for the dip baskets (13), the annealing furnace (1) having a cooling zone (8) which is under a protective gas atmosphere, this cooling zone being separated from the furnace chamber (2) by the vacuum inlet gate (5) and the vacuum outlet gate (7), the furnace chamber (2) and the cooling zone (8) containing a pusher device (6, 9) for the cyclic feeding of the conveyor boxes (4), the emptying device (11) within the vacuum outlet gate (7) comprising a tilting unit for emptying the conveyor boxes (4) into a funnel-like filling device (21) having an outlet opening (22) arranged below the level (23) of the metal bath (14) and above the dip basket (13) to be respectively charged and being in the dipping and filling position (13*c*).

2. Installation according to claim 1, further comprising a roller conveyor belt (18) for transporting the dip baskets (13) with the metallized workpieces form the quenching and aftertreatment baths (16, 17) to the unloading stations (19) and for transporting the empty dip baskets (13) from the unloading stations (19) to the metal bath (14), a manipulator (20) for lifting the dip baskets (13) off the roller conveyor belt (18), lowering of the dip baskets (13) from the circulating position (13*a*) into the dipping position (13*b*) into the metal bath (14), and for the cyclic transport of the dip baskets (13) through the metal bath (14) by way of the filling position (13*c*) below the filling device (21) into the discharge position (13*d*), a manipulator (24) for lifting the dip baskets (13) out of the metal bath (14) into the rotary position (13*e*) for removing the excess metal by centrifuging above one of a collecting basin (25) for transporting the dip baskets (13) from the rotary position (13*e*) through the quenching and aftertreatment baths (16, 17) to the roller conveyor belt (18).

3. Installation according to claim 1, wherein the rearward section (15*b*) of basket guide means (15*a*) in a dipping basin (15) of the metal bath (14) forms an inclined guide means for lifting the dip baskets (13) from the dipping position (13*b*) into the discharge position (13*d*).

4. Installation according to claim 1, further comprising a centrifuge (26) for accommodating the dip baskets (13) in the position (13*e*) above the metal bath (14) or above a separate collecting basin (25).

5. Installation according to claim 4, further comprising a main manipulator (32) designed as a column swiveling device for performing the functions of the roller conveyor belt (18) and of the firstmentioned manipulators (20, 24, 27).

6. Installation according to claim 4, further comprising a circulating endless chain conveyor (34) for executing the functions of the roller conveyor belt (18) and of the manipulators (20, 24, 27).

* * * * *